US009857135B1

(12) United States Patent
Geiger

(10) Patent No.: US 9,857,135 B1
(45) Date of Patent: Jan. 2, 2018

(54) SHOTGUN RIB

(71) Applicant: Otto Geiger, Coral Springs, FL (US)

(72) Inventor: Otto Geiger, Coral Springs, FL (US)

( * ) Notice: Subject to any disclaimer, the term of this patent is extended or adjusted under 35 U.S.C. 154(b) by 185 days.

(21) Appl. No.: 14/922,371

(22) Filed: Oct. 26, 2015

Related U.S. Application Data

(60) Provisional application No. 62/068,339, filed on Oct. 24, 2014.

(51) Int. Cl.
*F41A 21/00* (2006.01)
*F41C 7/00* (2006.01)
*F41G 1/00* (2006.01)

(52) U.S. Cl.
CPC ..... *F41A 21/00* (2013.01); *F41C 7/00* (2013.01); *F41G 1/00* (2013.01)

(58) Field of Classification Search
CPC ... F41G 1/00; F41G 1/42; F41G 1/425; F41A 11/00; F41A 11/02; F41A 21/00; F41A 21/06; F41A 21/48–21/488; F41C 7/00–7/12
See application file for complete search history.

(56) References Cited

U.S. PATENT DOCUMENTS 3,726,037 A * 4/1973 Wolff ..... F41A 21/24 42/112
3,979,851 A * 9/1976 Soucy ..... F41A 21/00 42/75.02
4,010,564 A * 3/1977 Pettit ..... F41G 1/24 42/112
4,878,308 A * 11/1989 Rose ..... F41G 1/425 42/112
2004/0200116 A1* 10/2004 Gussalli Beretta ..... F41G 1/425 42/112
2009/0113780 A1* 5/2009 Irwin ..... F41G 1/425 42/112
2010/0212204 A1* 8/2010 Koyama ..... F41A 21/24 42/73

* cited by examiner

*Primary Examiner* — Gabriel Klein
(74) *Attorney, Agent, or Firm* — Patents on Demand P.A.; Brian K. Buchheit

(57) ABSTRACT

A firearm system can include a modular mono-block shotgun system and a standardizing sighting system. The modular mono-block shotgun system can have multiple interchangeable barrels of different gauges for assembling a single shotgun. Each barrel can include an inherent low-rail sight longitudinally along its top surface. The standardizing sighting system can be installed upon the low-rail sight of each barrel of the modular mono-block system. The height of each barrel with its corresponding component of the standardizing sighting system can be substantially equal to the height of a largest gauge barrel with its corresponding component. After changing barrels, a need to make adjustments to the shotgun to account for changes in sighting and impact spread can be eliminated.

8 Claims, 3 Drawing Sheets

155

SHOTGUN RIB

CROSS-REFERENCE TO RELATED APPLICATIONS

This utility application is a conversion of a U.S. Provisional Application No. 62/068,339, filed on 24 Oct. 2014 and titled "A STANDARIZING SIGHTING SYSTEM FOR A MODULAR MONO-BLOCK', to which priority is claimed. The entire contents of 62/068,339 is incorporated by reference herein in its entirety.

BACKGROUND

The present invention relates to the field of gun sights and, more particularly, to a standardizing sighting system for a modular mono-block.

For competition shooting, the introduction of modular mono-block systems was a great advance. Having all the necessary different gauge barrels together in one interchangeable package is a great cost-savings over having separate shotguns for each gauge. However, the modular system propagates the same physical short-coming as having separate shotguns—each gauge requires the shooter to adjust their shooting parameters (e.g., stance, hold, targeting, etc.) to accommodate physical differences between different gauges.

While the barrels of the modular system are interchangeable, the assembled shotgun in not interchangeable in the shooter's hands. That is, a shooter is unable to hold a modular shotgun with a 20-gauge barrel the same way they would hold the modular shotgun with a 12-gauge barrel. While this may not seem like a huge obstacle, in competition shooting, every second spent having to readjust for gauge changes is a detriment to performance.

What is needed is a means to standardize the barrels of a modular mono-block shotgun system to mitigate physical differences and decrease the need for a shooter to readjust after changing barrels.

BRIEF SUMMARY

One aspect of the present invention can include a firearm system that includes a modular mono-block shotgun system and a standardizing sighting system. The modular mono-block shotgun system can have multiple interchangeable barrels of different gauges for assembling a single shotgun. Each barrel can include an inherent low-rail sight longitudinally along its top surface. The standardizing sighting system can be installed upon the low-rail sight of each barrel of the modular mono-block system. The height of each barrel with its corresponding component of the standardizing sighting system can be substantially equal to the height of a largest gauge barrel with its corresponding component. After changing barrels, a need to make adjustments to the shotgun to account for changes in sighting and impact spread can be eliminated.

Another aspect of the present invention can include a method for standardizing different gauge shotgun barrels. Such a method can begin with obtaining a modular mono-block shotgun system having interchangeable barrels for assembling a single shotgun. Each barrel can be of a different gauge and can include a low-rail sight longitudinally along its top surface. A high-rail sight extension of a standardizing sighting system can be selected that is appropriate for a gauge of each barrel. The low-rail sight can be removed from each barrel. The high-rail sight extension can then be permanently mounted onto the low-rail sight. The ability for the low-rail sight to attach to a barrel can be preserved. The combination of the low-rail sight and the high-rail sight extension can be reattached to each barrel, wherein a height of each barrel with the combination attached is substantially equal. Adjustments to the shotgun to account for changes in sighting and impact spread can be unnecessary after changing barrels.

Yet another aspect of the present invention can include a high-rail standardizing sighting system that includes high-rail sight extensions for installing upon low-rail sights attached to barrels of a modular mono-block shotgun system. The barrels of the modular mono-block shotgun system can be interchangeable and of different gauges. The height of each barrel with its corresponding high-rail sight extension installed can be substantially equal. After changing barrels, a need to make adjustments to an assembled shotgun to account for changes in sighting and impact spread can be eliminated. Each high-rail sight extension can be comprised of a rail and risers. The rail can be of a predetermined thickness and of a length matching a corresponding length of the low-rail sight. The risers can extend from a bottom surface of the rail. The position of each riser along the rail can correspond to a riser of the low-rail sight. The length of each riser can match its corresponding riser of the low-rail sight. The width of each riser can be at most as wide as the low-rail sight. The height of each riser can be such that the rail is level with respect to the barrel after being permanently mounted on the low-rail sight. The riser mounted nearest the buttstock can be elongated and tapered to provide a visual gradient from the low-rail sight to the high-rail sight extension.

DETAILED DESCRIPTION

The present invention discloses a solution for standardizing the different gauge barrels of a modular mono-block shotgun system. A standardizing sighting system can be comprised of high-rail sight extensions, one for each shotgun barrel gauge in the modular system. Each high-rail sight extension can be permanently mounted to a low-rail sight included on the barrel. After installation of the standardizing sighting system onto the barrels of the modular mono-block shotgun system, the overall height of each barrel can be substantially identical, which eliminates the need for a shooter to make adjustments to their position and/or the shotgun when changing barrels.

Figure 1:
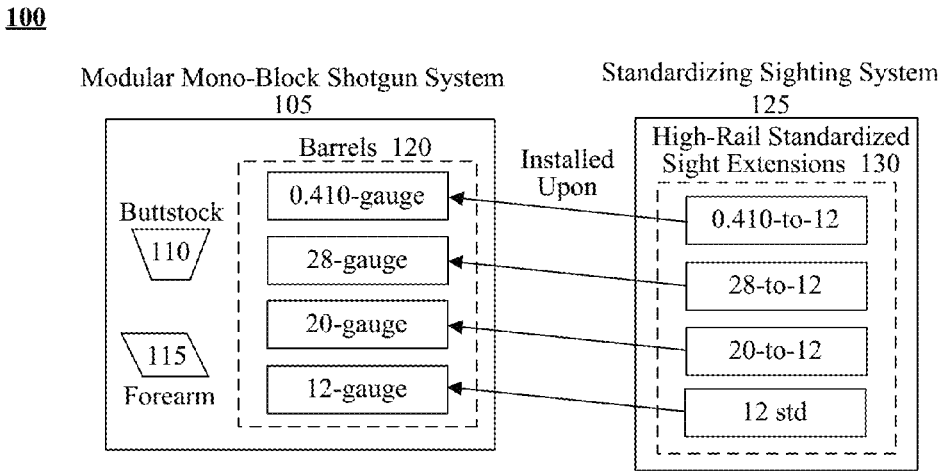
FIG. 1 is a schematic diagram illustrating a system for standardizing the barrels of a modular mono-block shotgun system using a standardizing sighting system in accordance with embodiments of the inventive arrangements disclosed herein.

FIG. 1 is a schematic diagram illustrating a system 100 for standardizing the barrels 120 of a modular mono-block shotgun system 105 using a standardizing sighting system 125 in accordance with embodiments of the inventive arrangements disclosed herein. In system 100, the standardizing sighting system 125 can be installed upon the barrels 120 of the modular mono-block shotgun system 105.

The modular mono-block shotgun system 105 can be a system of modular components for assembling a shotgun, such as the BLASER F3 SHOTGUN and the MOSSBERG FLEX 500. Such a system 105 can include a buttstock 110, forearm 115 element, barrels 120 of different gauges, and the like. As shotguns and modular mono-block shotgun systems 105 are well known in the Art, only those concepts and/or elements pertinent to the present invention shall be discussed in detail herein.

It can be assumed that each barrel 120 includes a low-rail sight (not shown), also referred to as a rib, that runs along the top of the barrel 120, as is common in modular mono-block shotgun systems 105. A front bead can included upon this low-rail for sighting purposes.

Different modular mono-block shotgun systems 105 can support different gauge barrels 120. The barrels 120 of the modular mono-block shotgun system 105 in system 100 can include a 0.410-gauge barrel (the smallest barrel diameter), 28-gauge barrel, a 20-gauge barrel, and a 12-gauge barrel (the largest barrel diameter). The diameter differences between the different gauge barrels 120 can change the overall height of the barrel 120. A different barrel 120 height can mean a different sighting point for the shooter that can require a change to how they hold the shotgun to accommodate, which can require adjustments to the buttstock 110, and so on. Therefore, changing the barrel 120 can require a shooter to take the time make all these adjustments. In a competition setting, a shooter cannot afford to lose time making adjustments.

The standardizing sighting system 125 can represent the means to permanently standardize the heights of the barrels 120 to the largest barrel 120 gauge. The standardizing sighting system 125 can benefit a shooter by eliminating the need to make changes based on barrel 120 height differences, which then eliminates the need for other related adjustments, and saving the shooter valuable time in competition.

The standardizing sighting system 125 can include high-rail sight extensions 130 for each barrel 120 gauge of the modular mono-block shotgun system 105. Each high-rail sight extension 130 can be specifically made for the corresponding barrel 120 gauge. That is, a high-rail sight extension 130 for a 28-gauge barrel 120 cannot be installed upon a 20-gauge barrel 120 and expected to function as being standardized.

Each high-rail sight extension 130 can be made of a durable material appropriate for being mounted upon the low-rail sight of the barrel 120 and exposed to the forces of repeatedly shooting the shotgun. Manufacturing processes can vary based upon the type of material. Finishes to the high-rail sight extension 130 can also vary based upon material and use. In one embodiment, the high-rail sight extension 130 can be machined from anodized aluminum.

Figure 1A:
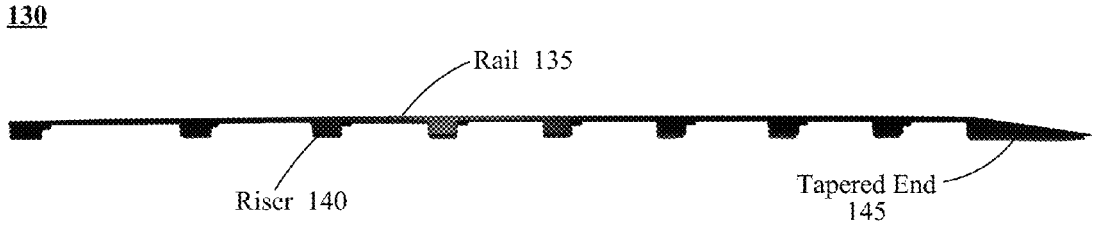
FIG. 1A is an example embodiment of a high-rail standardized sight in accordance with an embodiment of the inventive arrangements disclosed herein.

The high-rail sight extension 130, as shown in FIG. 1A, can look similar to the low-rail sight included on the barrel 120. The high-rail sight extension 130 can be comprised of a rail 135 and multiple risers 140. The rail 135 can be of a length, width, and thickness that is commensurate with the low-rail sight and/or barrel 120. The top surface of the rail 135 can be machined or otherwise worked to have a scalloping pattern that reduces glare for the shooter by redirecting environmental light away from the high-rail sight extension 130. Further, the rail 135 can allow for installation of a front bead to the high-rail sight extension 130.

Each riser 140 can be positioned along the rail 135 at points that correspond to the risers or other support structures of the low-rail sight to provide stability and a mounting point. The length of each riser 140 can match its corresponding riser on the low-rail sight. The width of the risers 140 should be at most as wide as the rail of the low-rail sight. The height of each riser 140 can be such to that the rail 135 is level with the barrel 120 once installed. That is, if the low-rail sight is sloped toward the front of the barrel 120, the risers 140 can increase in height toward the front of the barrel 120 to level the slope.

The riser 140 that will be nearest the buttstock 110 can be made into an elongated and tapered end 145 piece. The tapered end 145 can provide additional stability to the high-rail sight extension 130 and provide a visual gradient from the barrel 120 to the top of the rail 135. Further, the top surface of the tapered end 145 can continue the scalloping pattern of the rail 135 for additional glare reduction.

In another contemplated embodiment, weighting elements can be added to the risers 140 to compensate for differences in barrel 120 weights.

To promote design unity, the exterior surfaces of the risers 140, including the tapered end 145, can be worked to mirror any patterns already present on the risers of the low-rail sight. Further, the risers of the low-rail sight can be worked to match a desired pattern on the risers 140 of the high-rail sight extension 130.

Figure 1B:
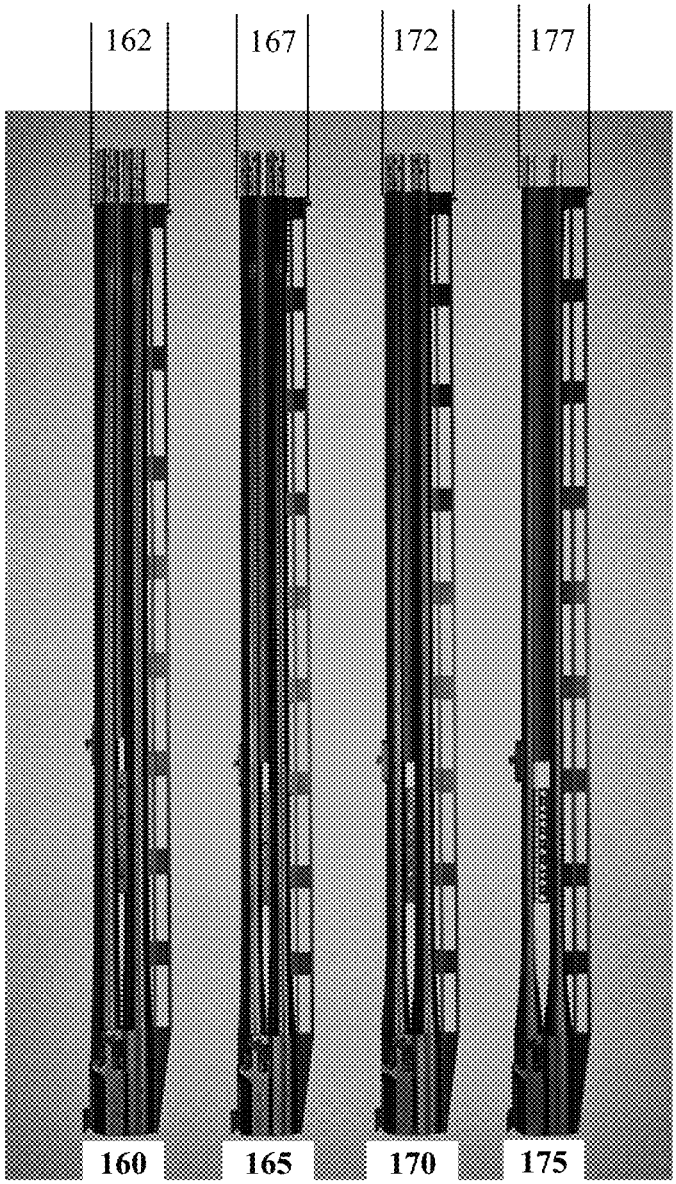
FIG. 1B is a collection of different gauge shotgun barrels standardized using the standardizing sighting system in accordance with an embodiment of the inventive arrangements disclosed herein.

Once each high-rail sight extension 130 is installed upon the corresponding barrel 120, the overall barrel 160, 165, 170, and 175 heights 162, 167, 172, and 177 can be standardized, as shown in collection 155 of FIG. 1B. Collection 155 can present a 12-gauge barrel 160 with high-rail sight extension 130, a 20-gauge barrel 165 with high-rail sight extension 130, a 28-gauge barrel 170 with high-rail sight extension 130, and a 410-gauge barrel 175 with high-rail sight extension 130.

As shown in collection 155, the height 167, 172, and 177 of each smaller gauge barrel 165, 170, and 175 can be standardized to the height 162 of the 12-gauge barrel 160. The height 162 of the 12-gauge barrel 160 can be used as the standard because it is the largest gauge of the modular mono-block shotgun system 105 and cannot be made to match a smaller gauge.

By using the low-rail sight as a template for the high-rail sight extension 130, the combination of the low-rail sight and high-rail sight extension 130 can be nearly visually indistinguishable.

Figure 2:
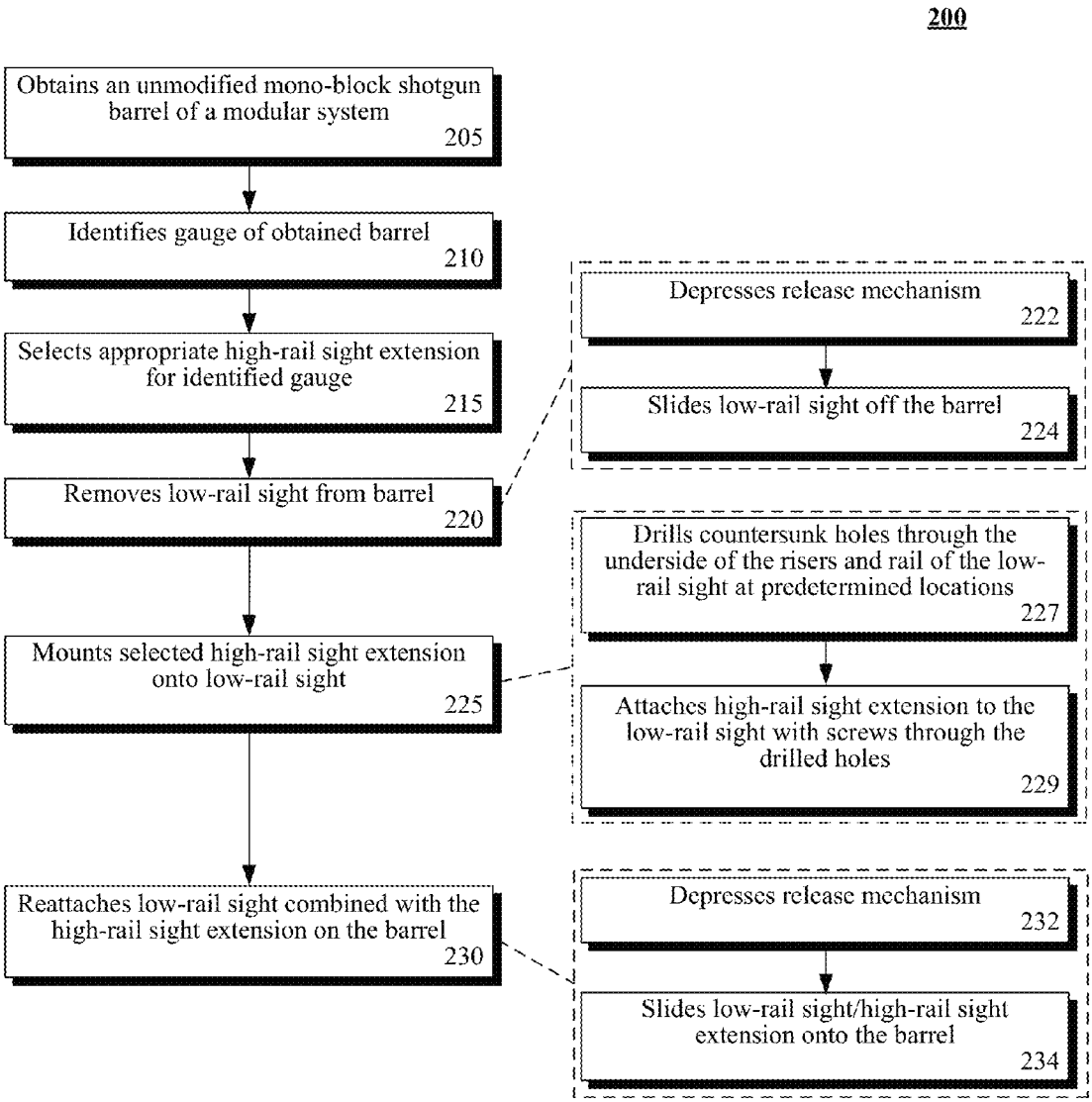
FIG. 2 is a flowchart of a method describing the standardization of the barrels of a modular mono-block shotgun system using the high-rail sight extensions of the standardizing sighting system in accordance with an embodiment of the inventive arrangements disclosed herein.

FIG. 2 is a flowchart of a method 200 describing the standardization of the barrels of a modular mono-block shotgun system using the high-rail sight extensions of the standardizing sighting system in accordance with embodiments of the inventive arrangements disclosed herein. Method 200 can be performed within the context of system 100 and/or using the embodiment of FIG. 1A.

Method 200 can begin in step 205 where an unmodified mono-block shotgun barrel of a modular system can be obtained, such as from a customer requesting standardization or from a seller of the modular mono-block shotgun system. The gauge of the obtained barrel can be identified in step 210. While a customer or packaging should provide this information, the gauge can be typically verified by markings on the barrel.

In step 215, the appropriate high-rail sight extension can be selected for the identified gauge. The low-rail sight can be removed from the barrel in step 220. Step 220 can require a variety of sub-steps to be performed that vary based on the specific modular mono-block shotgun system.

As an example, step 220 can require execution of sub-steps 222 and 224 when using a BLASER F3 SHOTGUN. In sub-step 222, a release mechanism located on the barrel at the rear of the low-rail sight (e.g., locking button) can be depressed. The low-rail sight can then slide off barrel in sub-step 224. Sub-steps 222 and 224 can be required to be performed repeatedly until the entirety of the low-rail slide is completely disengaged from the barrel.

In step 225, the selected high-rail sight extension can be mounted onto the low-rail sight. Like step 220, step 225 can also vary based on the specific modular mono-block shotgun system. Sub-steps 227 and 229 can represent the performance of step 225 on a BLASER F3 SHOTGUN.

In sub-step 227, countersunk holes can be drilled through the underside of the risers and rail of the low-rail sight at predetermined locations. The size and locations of the holes can be such to allow a stabile coupling between the low-rail sight and high-rail sight extension without overly degrading the integrity of the sight and extension. The high-rail sight extension can then be attached to the low-rail sight with screws through the drilled holes in sub-step 229.

In step 230, the low-rail sight combined with the high-rail sight extension can be reattached on the barrel. For a BLASER F3 SHOTGUN, step 230 can comprise sub-steps 232 and 234.

In sub-step 232, the release mechanism can be depressed, just like sub-step 222. The combination of the low-rail sight/high-rail sight extension can then slide back onto the barrel in sub-step 234. Because the holes were countersunk into the riser of the low-rail sight, it can be ensured that the screws used in sub-step 229 will not affect the ability of the low-rail sight to slide back on the barrel in sub-step 234. Further, sub-steps 232 and 234 can be required to be performed repeatedly until the entirety of the low-rail slide/high-rail sight extension is completely engaged on the barrel.

It should also be noted that the steps and sub-steps described in method 200 can be performed by a trained gun technician using the appropriate tools required to execute the described modifications for a specific modular mono-block shotgun system.

The flowchart and block diagrams in the Figures illustrate the architecture, functionality, and operation of possible implementations of systems and methods according to various embodiments of the present invention. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose tools that perform the specified functions or acts.

What is claimed is:

1. A firearm system comprising:

a modular mono-block shotgun system having a plurality of interchangeable barrels of different gauges for assembling a single shotgun, wherein each barrel includes an inherent low-rail sight longitudinally along its top surface;

a standardizing sighting system installed upon the low-rail sight of each barrel of the modular mono-block system, wherein a height of each barrel with its corresponding component of the standardizing sighting system is substantially equal to the height of a largest gauge barrel with its corresponding component of the standardizing sighting system, wherein, after changing barrels, a need to make adjustments to the shotgun to account for changes in sighting and impact spread is eliminated.

2. The firearm system of claim 1, wherein the standardizing sighting system comprises:

a plurality of high-rail sight extensions, wherein each high-rail sight extension further comprises:

a rail of a predetermined thickness and of a length matching a corresponding length of a corresponding low-rail sight of a corresponding barrel from the plurality of interchangeable barrels; and a plurality of risers extending from a bottom surface of the rail, wherein a position of each riser along the rail corresponds to a riser of the corresponding low-rail sight of the corresponding barrel, wherein a length of each riser matches its corresponding riser of the corresponding low-rail sight, wherein a width of each riser is at most as wide as the corresponding low-rail sight, wherein a height of each riser is such that the rail is level with respect to the corresponding barrel after being permanently mounted on the corresponding low-rail sight, wherein a riser mounted nearest a buttstock is elongated and tapered to provide a visual gradient from the corresponding low-rail sight to the high-rail sight extension.

3. The firearm system of claim 2, wherein the rail further comprises:

a means for installing a front bead.

4. The firearm system of claim 2, wherein each high-rail sight extension is made from anodized aluminum.

5. The firearm system of claim 2, wherein a top surface of the rail is worked to have a scalloping pattern that reduces glare.

6. The firearm system of claim 2, wherein exterior surfaces of the plurality of risers are worked to mirror a pattern on the exterior surfaces of corresponding risers on the corresponding low-rail sight, wherein the high-rail sight extension is substantially visually indistinguishable from the corresponding low-rail sight once mounted.

7. The firearm system of claim 2, wherein each high-rail sight extension is a single machined part.

8. The firearm system of claim 2, wherein the plurality of risers of high-rail sight extensions for barrels having gauges smaller than the largest gauge barrel include weights so that a weight of each barrel having a gauge smaller than the largest gauge barrel is substantially equal to the weight of the largest gauge barrel.

* * * * *